US008099276B2

(12) United States Patent
Takeuchi et al.

(10) Patent No.: US 8,099,276 B2
(45) Date of Patent: Jan. 17, 2012

(54) SOUND QUALITY CONTROL DEVICE AND SOUND QUALITY CONTROL METHOD

(75) Inventors: Hirokazu Takeuchi, Machida (JP); Hiroshi Yonekubo, Suginami-ku (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/893,839

(22) Filed: Sep. 29, 2010

(65) Prior Publication Data

US 2011/0178805 A1 Jul. 21, 2011

(30) Foreign Application Priority Data

Jan. 21, 2010 (JP) ..... 2010-011428

(51) Int. Cl.
*G10L 19/00* (2006.01)

(52) U.S. Cl. ..... 704/230; 704/226; 704/233; 704/225; 704/207; 704/203; 381/94.3

(58) Field of Classification Search ..... 704/226, 704/278, 233, 225, 203, 230, 207; 381/94.3
See application file for complete search history.

(56) References Cited

U.S. PATENT DOCUMENTS 5,142,656 A * 8/1992 Fielder et al. ..... 704/229
5,752,225 A * 5/1998 Fielder ..... 704/229
6,724,976 B2 * 4/2004 Oshima ..... 375/261
6,934,677 B2 * 8/2005 Chen et al. ..... 704/200.1
7,146,313 B2 * 12/2006 Chen et al. ..... 704/230
7,240,001 B2 * 7/2007 Chen et al. ..... 704/230
7,565,213 B2 * 7/2009 Dittmar et al. ..... 700/94
7,707,034 B2 * 4/2010 Sun et al. ..... 704/262
7,831,434 B2 * 11/2010 Mehrotra et al. ..... 704/500
7,856,354 B2 12/2010 Yonekubo et al.
7,930,171 B2 * 4/2011 Chen et al. ..... 704/200.1
2005/0159947 A1 * 7/2005 Chen et al. ..... 704/230
2008/0267416 A1 * 10/2008 Goldstein et al. ..... 381/56
2009/0080666 A1 * 3/2009 Uhle et al. ..... 381/17

(Continued)

FOREIGN PATENT DOCUMENTS

JP 07-013586 1/1995

(Continued)

OTHER PUBLICATIONS

Japanese Patent Application No. 2010-011428; Notification of Reason for Refusal; Mailed Nov. 30, 2010 (English Translation).

*Primary Examiner* — Vijjay B Chawan
(74) *Attorney, Agent, or Firm* — Blakely, Sokoloff, Taylor & Zafman LLP

(57) ABSTRACT

According to one embodiment, a sound quality control device includes: a time domain analysis module configured to perform a time-domain analysis on an audio-input signal; a frequency domain analysis module configured to perform a frequency-domain analysis on a frequency-domain signal; a first calculation module configured to calculate first speech/music scores based on the analysis results; a compensation filtering processing module configured to generate a filtered signal; a second calculation module configured to calculate second speech/music scores based on the filtered signal; a score correction module configured to generate one of corrected speech/music scores based on a difference between the first speech/music score and the second speech/music score; and a sound quality control module configured to control a sound quality of the audio-input signal based on the one of the corrected speech/music scores.

5 Claims, 6 Drawing Sheets

U.S. PATENT DOCUMENTS

| | | | |
|---|---|---|---|
| 2009/0296961 | A1 | 12/2009 | Takeuchi et al. |
| 2009/0299750 | A1 | 12/2009 | Yonekubo et al. |

FOREIGN PATENT DOCUMENTS

| | | |
|---|---|---|
| JP | 2004-133403 | 4/2004 |
| JP | 2008-283318 | 11/2008 |
| JP | 4327886 | 9/2009 |
| JP | 4327888 | 9/2009 |
| JP | 2009-288707 | 10/2009 |

* cited by examiner

SOUND QUALITY CONTROL DEVICE AND SOUND QUALITY CONTROL METHOD

CROSS-REFERENCE TO RELATED APPLICATION(S)

This application is based upon and claims the benefit of priority from Japanese Patent Application No. 2010-011428, filed on Jan. 21, 2010, the entire contents of which are incorporated herein by reference.

FIELD

Embodiments described herein relate generally to a sound quality control device and method for adaptively performing sound quality control processing on a speech signal and a music signal included in an audio (audible frequency) signal to be reproduced.

BACKGROUND

For example, in a broadcasting receiving apparatus for receiving a television broadcasting or an information reproducing apparatus for reproducing information recorded on an information recording medium, when an audio signal is reproduced from the received broadcasting signal or the signal read from the information recording medium, sound quality control processing is performed on the audio signal to further enhance sound quality.

In this case, the type of the sound quality control processing is changed according to whether the received audio signal is a speech signal representing a human's speaking voice and the like or a music (non-speech) signal representing a music. For example, sound quality control processing is performed on a speech signal to clarify speech-sounds by emphasizing centrally-localized components thereof, as in talking-scene and live sport broadcasts. Thus, sound quality is improved. On the other hand, sound quality control processing is performed on a music signal to provide spaciousness with an emphasized stereophonic feeling.

For example, it is considered to determine whether a received audio signal is a speech signal or a music signal, and to then perform associated sound quality control processing according to a determination result. JP-H07-013586-A discloses a configuration in which acoustic signals are classified into three types of signals, i.e., a "speech" signal, a "non-speech" signal and an "undefined" signal by analyzing the zero-crossing counts, power variations and the like of input acoustic signals, and in which the frequency characteristics corresponding to the acoustic signal are controlled as follows. That is, when the acoustic signal is determined as a "speech" signal, the frequency characteristics corresponding to the acoustic signal are controlled to emphasize those in a speech band. When the acoustic signal is determined as a "non-speech" signal, the frequency characteristics are controlled to be flat. When the acoustic signal is determined as an "undefined" signal, the frequency characteristics are controlled to maintain characteristics determined by the last determination.

However, since speech signals and music signals are frequently mixed into actual audio signals, it was difficult to discriminate therebetween and to perform suitable sound quality control processing on an audio signal.

BRIEF DESCRIPTION OF THE DRAWINGS

A general architecture that implements the various feature of the present invention will now be described with reference to the drawings. The drawings and the associated descriptions are provided to illustrate embodiments of the present invention and not to limit the scope of the present invention.

DETAILED DESCRIPTION

In general, according to one embodiment, a sound quality control device includes: an input module configured to receive an audio-input signal; a time/frequency conversion module configured to perform a time/frequency conversion onto the audio-input signal to generate a frequency-domain signal therefrom; a time domain analysis module configured to perform a time-domain analysis on the audio-input signal to extract time domain characteristic parameters therefrom; a frequency domain analysis module configured to perform a frequency-domain analysis on the frequency-domain signal to extract frequency domain characteristic parameters therefrom; a first speech score calculation module configured to calculate a first speech score based on at least one of the time domain characteristic parameters and the frequency domain characteristic parameters, the first speech score representing a similarity between the audio-input signal and a reference speech signal; a first music score calculation module configured to calculate a first music score based on at least one of the time domain characteristic parameters and the frequency domain characteristic parameters, the first music score representing a similarity between the audio-input signal and a reference music signal; a compensation filtering processing module configured to perform at least one of a center enhancement, a speech band enhancement and a noise suppression onto the audio-input signal to generate a filtered signal therefrom; a second speech score calculation module configured to calculate a second speech score representing a similarity between the filtered signal and the reference speech signal; a second music score calculation module configured to calculate a second music score representing a similarity between the filtered signal and the reference music signal; a score correction module configured to generate a corrected speech score based on a difference between the first speech score and the second speech score, or to generate a corrected music score based on a difference between the first music score and the second music score; and a sound quality control module configured to control a sound quality of the audio-input signal based on the corrected speech score or the corrected music score.

Hereinafter, embodiments are described.

Embodiment 1

Embodiment 1 is described with reference to FIGS. 1 to 5.

Figure 1:
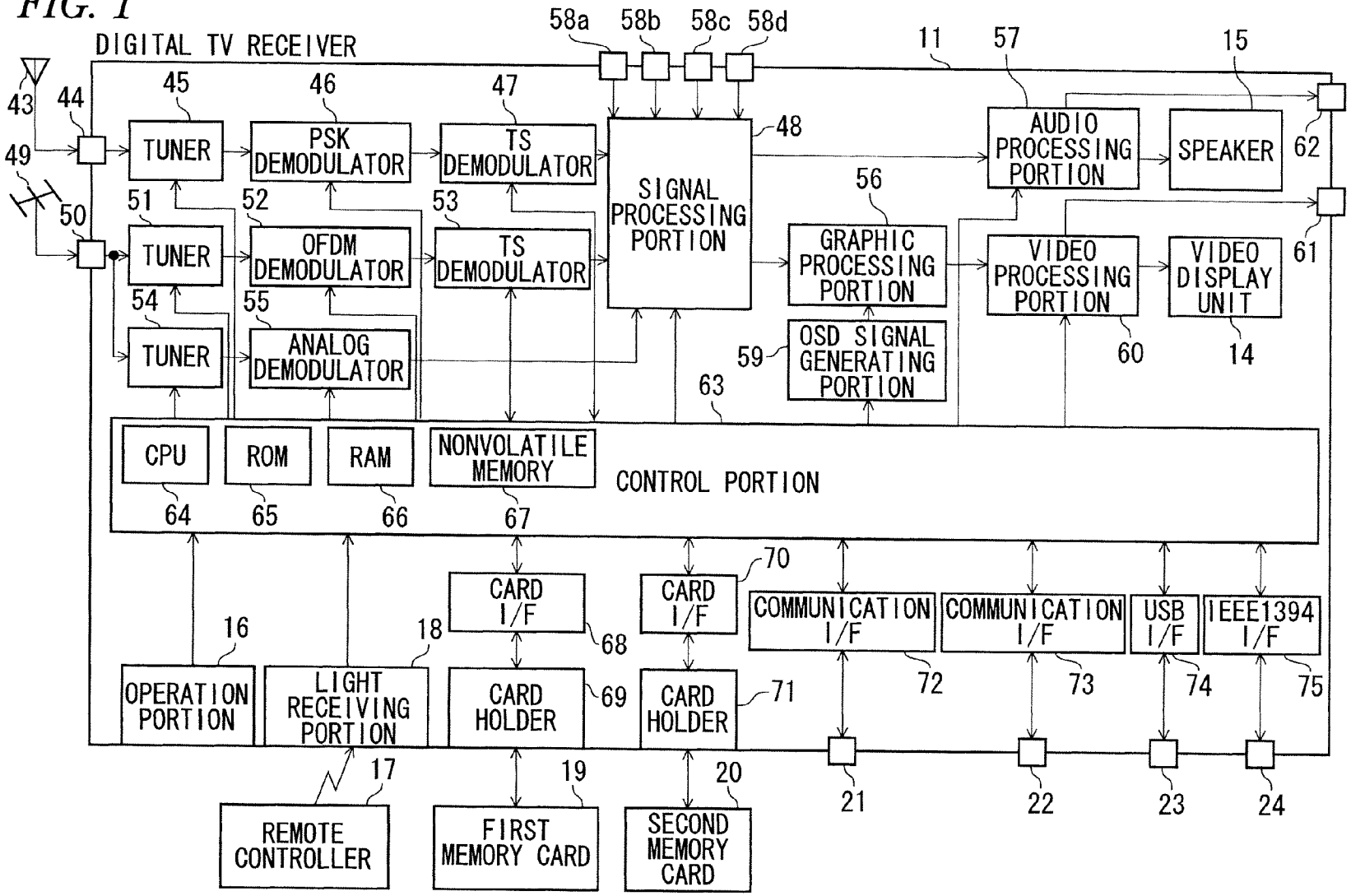
FIG. 1 illustrates an example block configuration of a digital TV receiver according to Embodiment 1.

FIG. 1 illustrates a main signal processing system of a digital TV receiver 11 according to Embodiment 1. That is, a satellite digital television broadcasting signal received by a broadcasting satellite/communication satellite (BS/CS) digital broadcasting receiving antenna 43 is supplied to a satellite digital broadcasting tuner 45 via an input terminal 44. Thus, a broadcasting signal of a desired channel is selected.

The broadcasting signals selected by the tuner 45 are sequentially supplied to a phase shift keying (PSK) demodulator 46 and a transport stream (TS) demodulator 47. The demodulators 46 and 47 demodulate the broadcasting signals into digital video signals and digital audio signals. Then, the digital video signals and the digital audio signals are output to a signal processing portion 48.

A terrestrial digital television broadcasting signal received by a terrestrial broadcasting receiving antenna 49 is supplied to a terrestrial digital broadcasting tuner 51 via an input terminal 50. Thus, a broadcasting signal of a desired channel is selected.

The broadcasting signals selected by the tuner 51 are sequentially supplied to an orthogonal frequency division multiplexing (OFDM) demodulator 52 and a TS demodulator 53 in, e.g., Japan. The demodulators 52 and 53 demodulate the signals into a digital video signal and a digital audio signal. Then, the digital video and audio signals are output to the signal processing portion 48.

A terrestrial analog television broadcasting signal received by the terrestrial broadcasting signal antenna 49 is supplied to a terrestrial analog broadcasting tuner 54 via the input terminal 50. Thus, a broadcasting signal of a desired channel is selected. Then, the broadcasting signal selected by the tuner 54 is supplied to an analog demodulator 55. The analog demodulator 55 demodulates the supplied broadcasting signal into an analog video signal and an analog audio signal. Then, the analog video and audio signals are output to the signal processing portion 48.

The signal processing portion 48 selectively performs predetermined digital signal processing on the digital video and audio signals supplied thereto from the TS demodulators 47 and 53. Then, the signal processing portion 48 outputs processed signals to a graphic processing portion 56 and an audio processing portion 57.

A plurality (e.g., four in the illustrated case) of input terminals 58*a*, 58*b*, 58*c*, and 58*d* are connected to the signal processing portion 48. Each of these input terminals 58*a* to 58*d* enables input of an analog video signal and audio signal from outside the digital TV receiver 11.

The signal processing portion 48 selectively digitizes an analog video signal and audio signal supplied from the analog demodulator 55 and each of the input terminals 58*a* to 58*d*. Then, the signal processing portion 48 performs predetermined digital signal processing on the digitized video and audio signals. After that, the signal processing portion outputs the processed signals to the graphic processing portion 56 and the audio processing portion 57.

The graphic processing portion 56 has the functions of superimposing an on-screen-display (OSD) signal generated by an OSD signal generating portion 59 on a digital video signal supplied from the signal processing portion 48, and outputting the superimposed signal. The graphic processing portion 56 can selectively output a video signal output by the signal processing portion 48 and an OSD signal output by the OSD signal generating portion 59. In addition, the graphic processing portion 56 can combine both of the output signals of the signal processing portion 48 and the OSD signal generating portion 59 so that each of the output signals includes a signal representing an associated half of the screen. Then, the graphic processing portion 56 can output the combined signals.

The digital video signal output from the graphic processing portion 56 is supplied to a video processing portion 60. The video processing portion 60 converts the input digital video signal into an analog video signal in a format displayable by a display unit 14. Then, the video processing portion 60 outputs the analog video signal to the display unit 14 such that the display unit 14 displays an image represented by the video signal. And, the video processing portion 60 transmits the video signal to the outside via an output terminal 61.

The audio processing portion 57 performs sound quality control processing described below on the input digital audio signal and then converts the digital audio signal into an analog audio signal in a format reproducible by the speakers 15. Then, the analog audio signal is output to the speakers 15 to be reproduced. In addition, the audio signal is transmitted to the outside via an output terminal 62. The speaker 15 serves as an output module that outputs an output audio signal in which the sound quality is controlled.

In the digital TV receiver 11, all operations thereof including the above various types of receiving-operations are administratively controlled by a control portion 63. The control portion 63 includes a central processing unit (CPU) 64 and controls each portion to reflect operation information received from the operation portion 16 or received from a remote controller 17 via a light receiving portion 18.

In this case, the control portion 63 utilizes mainly a read-only memory (ROM) 65 storing a control program to be executed by the CPU 64, a random access memory (RAM) 66 providing a work area to the CPU 64 and a nonvolatile memory storing various setting information, control information and the like.

The control portion 63 is connected to a card holder to which a first memory card 19 is mountable via a card interface (I/F) 68. Consequently, the control portion 63 can transmit information to the first memory card 19 mounted in the card holder 69 via the card I/F 68.

Also, the control portion 63 is connected to a card holder 71 to which a second memory card 20 is mountable via a card I/F 70. Consequently, the control portion 63 can transmit information to the second memory card 20 mounted in the card holder 71 via the card I/F 70.

Further, the control portion 63 is connected to the first local area network (LAN) terminal 21 via a communication I/F 72. Thus, the control portion 63 can transmit information to the LAN-compatible hard disk drive (HDD) 25 connected to a first LAN terminal 21 via the communication I/F 72. In this case, the control portion 63 has a dynamic host configuration protocol (DHCP) server function. The control portion 63 controls the LAN-compatible HDD 25 connected to the first LAN terminal 21 by allocating an Internet protocol (IP) address thereto.

And, the control portion 63 is connected to a second LAN terminal 22 via a communication I/F 73. Thus, the control portion 63 can transmit information to each device connected to the second LAN terminal 22 via the communication I/F 73.

The control portion 63 is also connected to a universal serial bus (USB) terminal 23 via a USB I/F 74. Thus, the control portion 63 can transmit information to each device connected to the USB terminal 23 via the USB I/F 74.

In addition, the control portion 63 is connected to an Institute of Electrical and Electronics Engineers (IEEE) 1394 terminal 24 via an IEEE 1394 I/F 75. Thus, the control portion 63 can transmit information to each device connected to the IEEE 1394 terminal 24 via the IEEE 1394 I/F 75.

Figure 2:
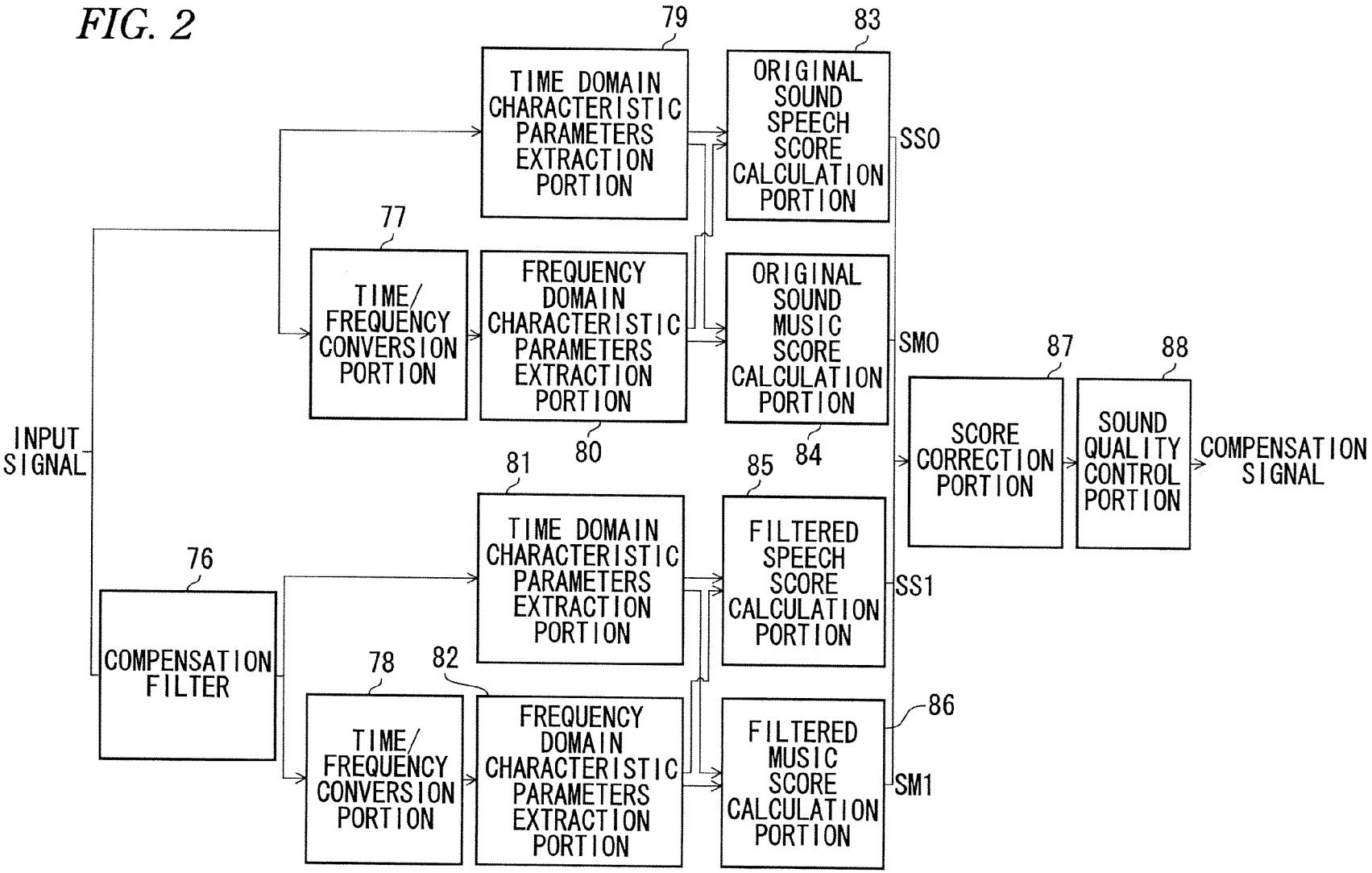
FIG. 2 illustrates an example block configuration of a sound quality control device according to Embodiment 1.

FIG. 2 illustrates an example block configuration of a sound quality control device provided in an audio processing portion 57 and configured to adaptively perform sound quality control processing. This device includes time domain characteristic parameters extraction portions 79, 81, time/frequency conversion portions 77 and 78, frequency domain characteristic parameters extraction portions 80 and 82, an original sound speech score calculation portion 83, an original sound music score calculation portion 84, a compensation filter 76, a filtered speech score calculation portion 85, a filtered music score calculation portion 86, a score correction portion 87 and a sound quality control portion 88. This device performs the scoring of a similarity level to speech and a similarity level to music from characteristic parameters of an original sound input signal superimposed with signals representing background sounds (handclaps, cheers, BGM and the like) in determining whether the input signal represents speech or music. In addition, this device performs the scoring of the similarity level to speech and the similarity level to music from characteristic parameters of a compensation signals subjected to compensation filtering processing (speech-band enhancement, center enhancement and the like) suitable for speech extraction. Then, this device performs scoring-correction, according to the difference between the scores of each of the original signals and the compensation signal. Thus, detection accuracy for a mixed signal containing a speech signal can be enhanced. In addition, effective sound quality control suitable for an input signal can be realized.

Each of the time domain characteristic parameters extraction portions 79 and 81 extracts frames from an input audio signal every several hundreds of milliseconds (msec.) or so, divides each frame into sub-frames of several tens msec., and obtains a power value, a zero-crossing frequency and a power ratio between the left and right (LR) channel signals (in the case of a stereo signal) for each sub-frame. Then, each of the time domain characteristic parameters extraction portions 79 and 81 calculates statistic amounts (average/variance/maximum/minimum and the like) of the obtained values corresponding to each frame, and extracts the calculated statistic amounts as characteristic parameters. Each of the time/frequency conversion portions 77 and 78 performs a discrete Fourier transform on a signal corresponding to each sub-frame to thereby convert the corresponding signal into a frequency domain signal. Each of the frequency domain characteristic parameters extraction portions 80 and 82 obtains a spectral variation, a mel-frequency cepstrum coefficient (MFCC) variation and an energy concentration ratio of a specific frequency band (a bass component of a musical instrument). Then, each of the frequency domain characteristic parameters extraction portions and 82 calculates the statistic amounts (average/variance/maximum/minimum and the like) of the obtained values corresponding to each frame and employs the calculated amounts as characteristic parameters. For example, as the techniques described in Japanese Patent Application Nos. 2009-156004 and 2009-217941 filed by the present inventors, each of the original sound speech score calculation portion 83 and the original sound music score calculation portion 84 calculates, from the time-domain and frequency-domain characteristic parameters, value representing how much the characteristic of signal is close to that of a speech signal (voice) and value representing how much the characteristic of signal is similar to that of a music signal (musical composition) as an original sound speech score SS0 and an original sound music score SM0, respectively. At the calculation of the scores, first, a speech/music discrimination score S1 is calculated as a linear sum of elements of a characteristic parameter set $x_i$, which are respectively weighted by weighting-coefficients $A_i$, as expressed in the following equation. This score performs linear discrimination so as to have a positive value if the similarity level to music is higher and as to have a negative value if the similarity level to speech is higher.

$$S1=A_0+\Sigma_i A_i x_i \quad \text{(Equation 1)}$$

The weighting coefficients $A_i$ are determined by preliminarily performing offline learning using large amounts of known speech signal data and music signal data, which are preliminarily prepared, as reference data. According to the learning, the coefficients are determined such that the speech/music discrimination score S1 with respect to all reference data is 1.0 if the signal represents speech, while the score S1 is −1.0 if the signal represents music, and that an error between S1 for the reference data and a reference score (1.0 for speech, −1.0 for music) is minimized.

Then, a background-sound/music discrimination score S2 is calculated to discriminate background sounds from music. The background-sound/music discrimination score S2 is obtained by being calculated as a linear sum of elements of a characteristic parameter set $y_i$, which are respectively weighted by weighting-coefficients $B_i$, similarly to the speech/music discrimination score S1. However, characteristic parameters, such as an energy concentration ratio of the specific frequency band corresponding to the bass component, for discriminating background sounds from music is newly added to the characteristic parameters. The score 52 performs linear discrimination so as to have a positive value if the similarity level to music is higher and as to have a negative value if the similarity level to background-sounds is higher.

$$S2=B_0+\Sigma_i B_i y_i \quad \text{(Equation 2)}$$

Figure 3:
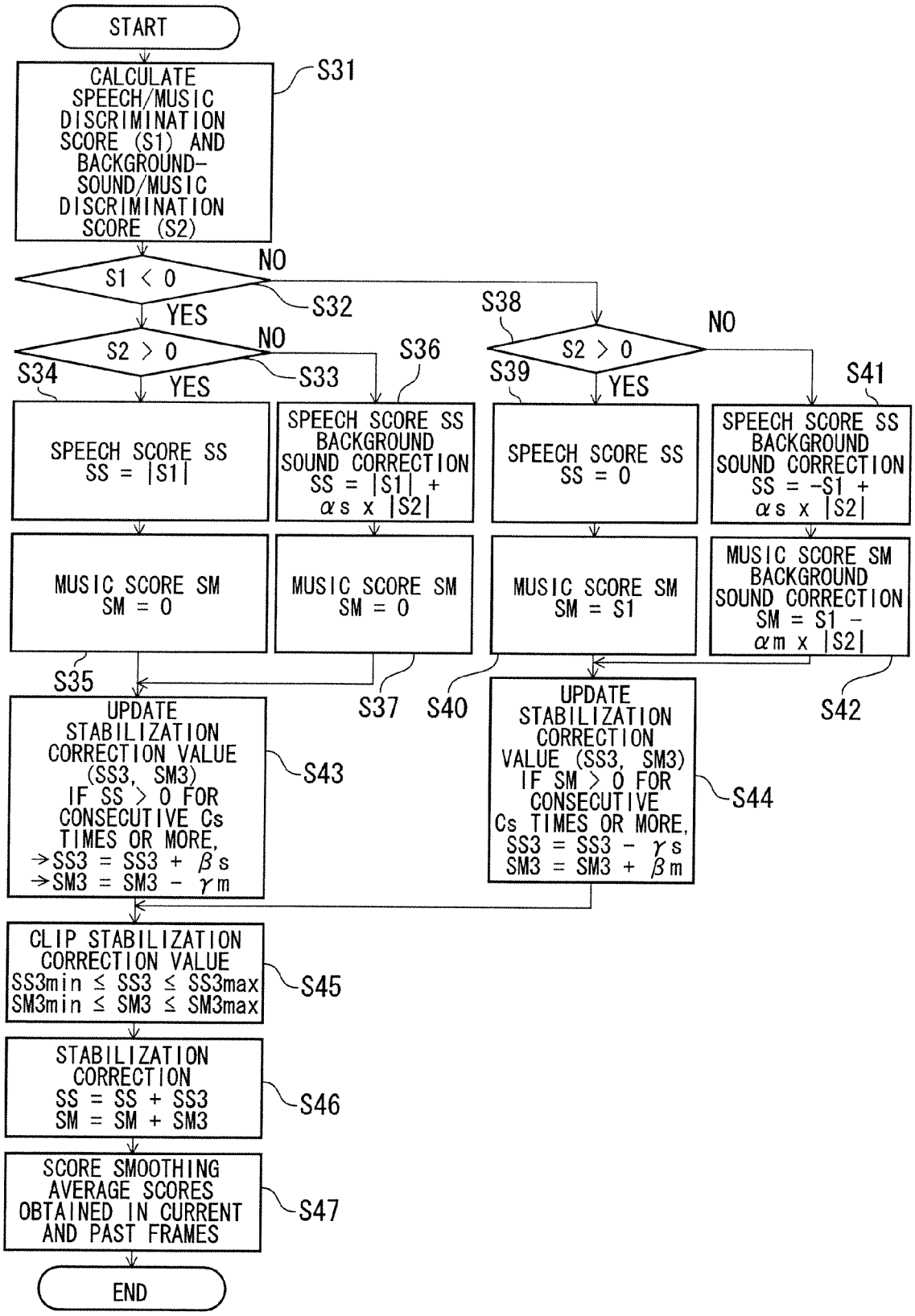
FIG. 3 illustrates a process for calculating a speech score and a music score according to Embodiment 1.

The weighting coefficients $B_i$ are determined, similarly to the weighting coefficients $A_i$ for discriminating between speech and music, by preliminarily performing offline learning using large amounts of known background-sound signal data and music signal data, which are preliminarily prepared, as reference data. An original sound speech score SS0 and an original sound music score SM0 are calculated from the above scores S1 and S2 as scores respectively corresponding to different types of sounds, through a background sound correction process and a stabilization process, as illustrated in FIG. 3, as the techniques described in Japanese Patent Application Nos. 2009-156004 and 2009-217941. The original sound speech score SS0 and the original sound music score SM0 are calculated, based on the above speech/music discrimination score S1 and the above background-sound/music discrimination score S2. Similarly, the filtered speech score SS1 and the filtered music score SM1 are calculated. As illustrated in FIG. 3, the original sound speech score SS0 and the filtered speech score SS1 are collectively designated as a speech score SS, while the original sound music score SM0 and the filtered music score SM1 are collectively designated as a music score SM.

As illustrated in FIG. 3, first, in step S31, each of the score calculation portions calculate the above scores S1 and S2, respectively. Then, the score correction portion 87 performs the following background sound correction. That is, if S1<0 (the sound is more similar to speech than music, Yes in step S32) and S2>0 (the sound is more similar to music than background sounds, Yes in step S33), in step S34, the speech score SS is set at an absolute value |S1| of the speech/music discrimination score S1, since the speech/music discrimination score S1 has a negative value. In step S35, since the characteristic of the sound is similar to that of a speech signal, the music score SM is set to 0. If S1<0 (the sound is more similar to speech than music, Yes in step S32) and S2 is not more than 0 (the sound is more similar to a background sound than music, No in step S33), in step S36, the speech score SS is corrected in consideration of a speech component contained in the background sound by adding $\alpha s \times |S2|$ to the absolute value |S1|, since the score S1 is a negative value. In step S37, since the characteristic of the sound is similar to that of a speech signal, the music score SM is set to 0.

If S1 is not less than 0 (the sound is more similar to music than speech, No in step S32) and S2>0 (the sound is more similar to music than the background sound, Yes in step S38), in step S39, the speech score SS is set to 0, since the characteristic of the sound is similar to that of a music signal. In step S40, the music score SM is set at the score S1 corresponding to the similarity level to a music signal. If S1 is not less than 0 (the sound is more similar to music than speech, No in step S32) and S2 is not more than 0 (the sound is more similar to a background sound than music, No in step S38), in step S41, the speech score SS is corrected in consideration of a speech component contained in the background sound by adding $\alpha s \times |S2|$ to the score −S1 corresponding to the similarity level to speech. In step S42, the music score SM is corrected in consideration of the similarity level to the background sound by subtracting $\alpha m \times |S2|$ from the score S1 corresponding to the similarity level to a music signal.

Stabilization correction is performed by adding on each of values SS3 and SM3 each of which is a parameter, whose initial value is 0, to be corrected according to the continuousness of each of the speech score SS and the music score SM.

For example, if SS>0 for consecutive Cs-times or more in step S43 subsequent to step S35 and to step S37, a predetermined positive value βs for adjusting the parameter SS3 is added to the parameter SS3 in step S43. In addition, a predetermined positive value γm for adjusting the parameter SM3 is subtracted from the parameter SM3. If SM>0 for consecutive Cm-times or more in step S44 subsequent to step S40 and to step S42, a predetermined value γs for adjusting the parameter SM3 is subtracted from the parameter SM3 in step S43. In addition, a predetermined value βm for adjusting the parameter SM3 is added to the parameter SM3.

Then, in order to prevent the speech score and the music score from being excessively corrected due to the stabilization parameters SS3 and SM3 generated in the above steps S43 and S44, respectively, the score correction portion 87 performs clipping processing on the stabilization parameters SS3 and SM3 in step S45 so that the stabilization parameter SS3 is within a range between a preset minimum value $SS3_{min}$ and a preset maximum value $SS3_{max}$, and that the stabilization parameter SM3 is within a range between a preset minimum value $SM3_{min}$ and a preset maximum value $SM3_{max}$.

Finally, in step S46, the stabilization correction is performed using the parameters SS3 and SM3. In step S47, the calculation of the average (moving average) of the scores obtained in the current and the past frames is performed as score-smoothing.

Figure 4:
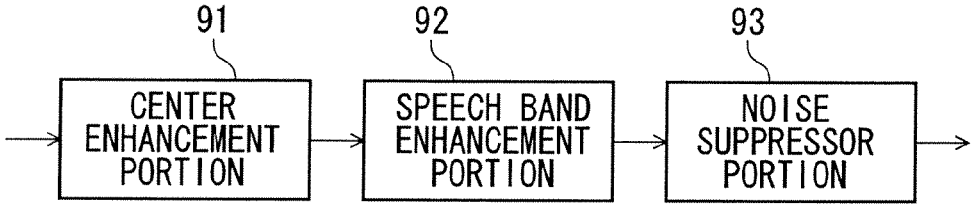
FIG. 4 illustrates an example block configuration of a compensation filter according to Embodiment 1.

On the other hand, characteristic parameters extraction is performed on a signal suitable for speech extraction, separately from the original sound input signal. As illustrated in FIG. 4, the compensation filter portion 76 includes a center enhancement portion 91, a speech band enhancement portion 92 and a noise suppressor portion 93. Generally, in the case of a broadcasting signal and the like, a sound image of a speech signal is usually centrally-localized. Thus, the center enhancement portion 91 performs processing on a stereo signal to more facilitate the extraction of speech by enhancing a sum of the LR channel signals. The speech band enhancement portion 92 performs equalizing processing to enhance a frequency band of 300 Hertz (Hz) to 7 kHz, in which the component of a speech signal is likely to more prominently appear (or attenuate the signal component of the other frequency bands). The noise suppressor portion 93 performs processing to suppress stationary noise components in order to alleviate the influence of background noises input by being mixed in speech.

The calculation of a speech score SS1 and a music score SM1 is performed on filtered signals passed through the compensation filter, similarly to the calculation of the scores, which is performed on the original sound signal. Processing performed by the time/frequency conversion portion 78, the time domain characteristic parameters extraction portion 81, and the frequency domain characteristic extraction portion 82 is similar to that performed on the original sound signal. However, the filtered speech score calculation portion 85 utilizes the coefficients preliminarily learned using the filtered signals in the process of obtaining the weighting coefficients $A_i$ and $B_i$ used when the speech/music discrimination score S1 and the background-sound/music discrimination score S2 are calculated. Thus, the original sound speech score SS0, the original sound music score SM0, the filtered speech score SS1, and the filtered music score SM1 are obtained corresponding to the original sound signal and the signal filtered by the compensation filter. The score correction portion 87 performs score correction on a speech/music mixture signal, based on the four scores, to calculate a speech score and a music score. This processing is described below in detail with reference to FIG. 5. The sound control portion 88 controls, according to the speech score and the music score, how much the sound quality control is performed on each of speech and music, as the techniques described in Japanese Patent Application Nos. 2009-156004 and 2009-217941. Thus, optimum sound quality control appropriate to the characteristics of signals representing contents is realized.

Figure 5:
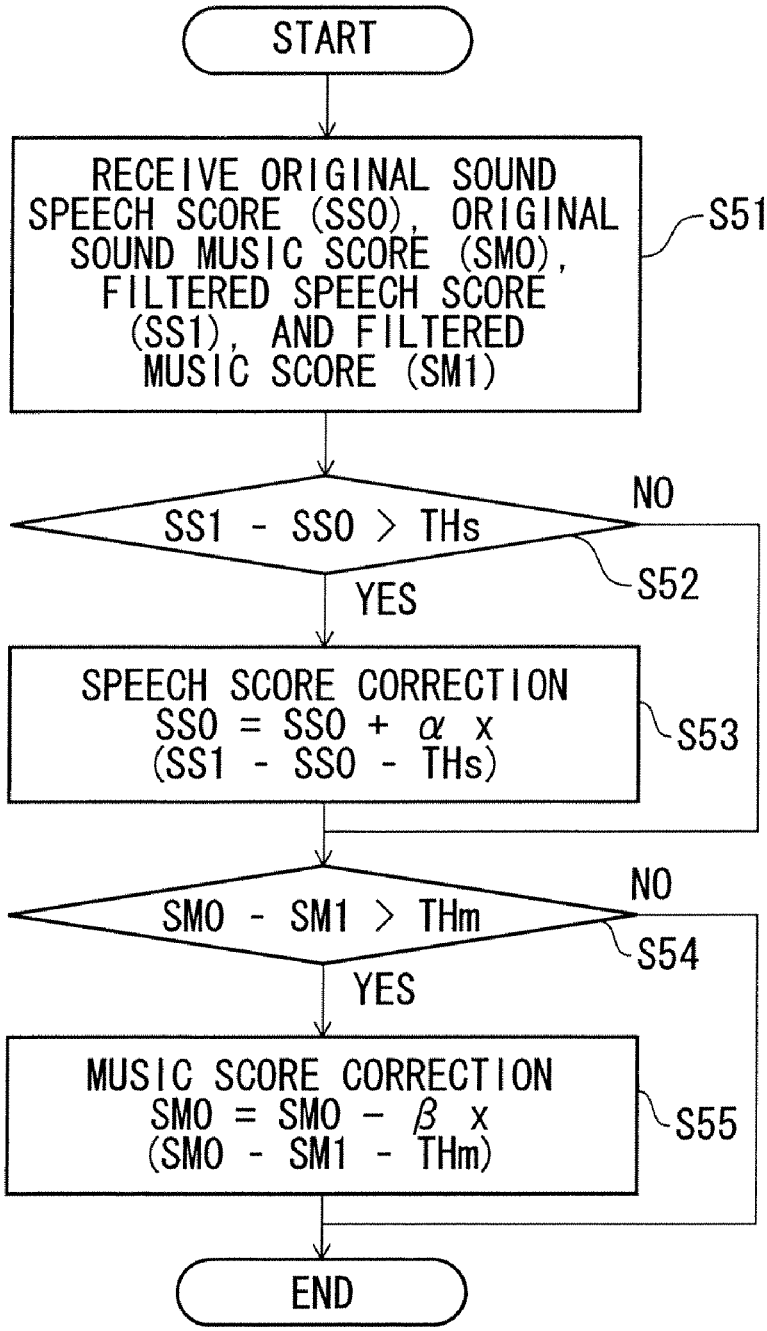
FIG. 5 illustrates a score correction process according to Embodiment 1.

FIG. 5 illustrates a process performed by the score correction portion 87 utilizing these scores. After the four scores are received in step S51, the original sound speech score SS0 and the filtered speech score SS1 are compared with each other in step S52. If the corrected score is larger than the original sound score by a threshold THs or more, it is determined that many speech components, which cannot be detected in the original sound, are contained in the filtered signal. In step S53, the score correction portion 87 corrects the speech score so as to be increased according to the following equation.

$$SS0=SS0+\alpha\times(SS1-SS0-THs) \quad \text{(Equation 3)}$$

where α is a constant for adjusting a correction amount corresponding to the difference between the scores. Then, in step S54, the original sound music score SM0 and the filtered music score SM1 are compared with each other. If the original sound score is larger than the corrected score by a threshold THm or more, it is determined that many speech components, which cannot be detected in the original sound, are further contained in the filtered signal. In step S55, the score correction portion 87 corrects the music score so as to be reduced according to the following equation.

$$SM0=SM0-\beta\times(SM0-SM1-THm) \quad \text{(Equation 4)}$$

where β is a constant for adjusting a correction amount corresponding to the difference between the scores. According to the above flow, the original sound speech score SS0 and the original sound music score SM0 to be obtained in consideration of the output by the compensation filter are calculated.

Embodiment 2

Embodiment 2 is described hereinafter with reference to FIGS. 1, and 3 to 6. The description of portions common to Embodiment 1 and Embodiment 2 is omitted.

Figure 6:
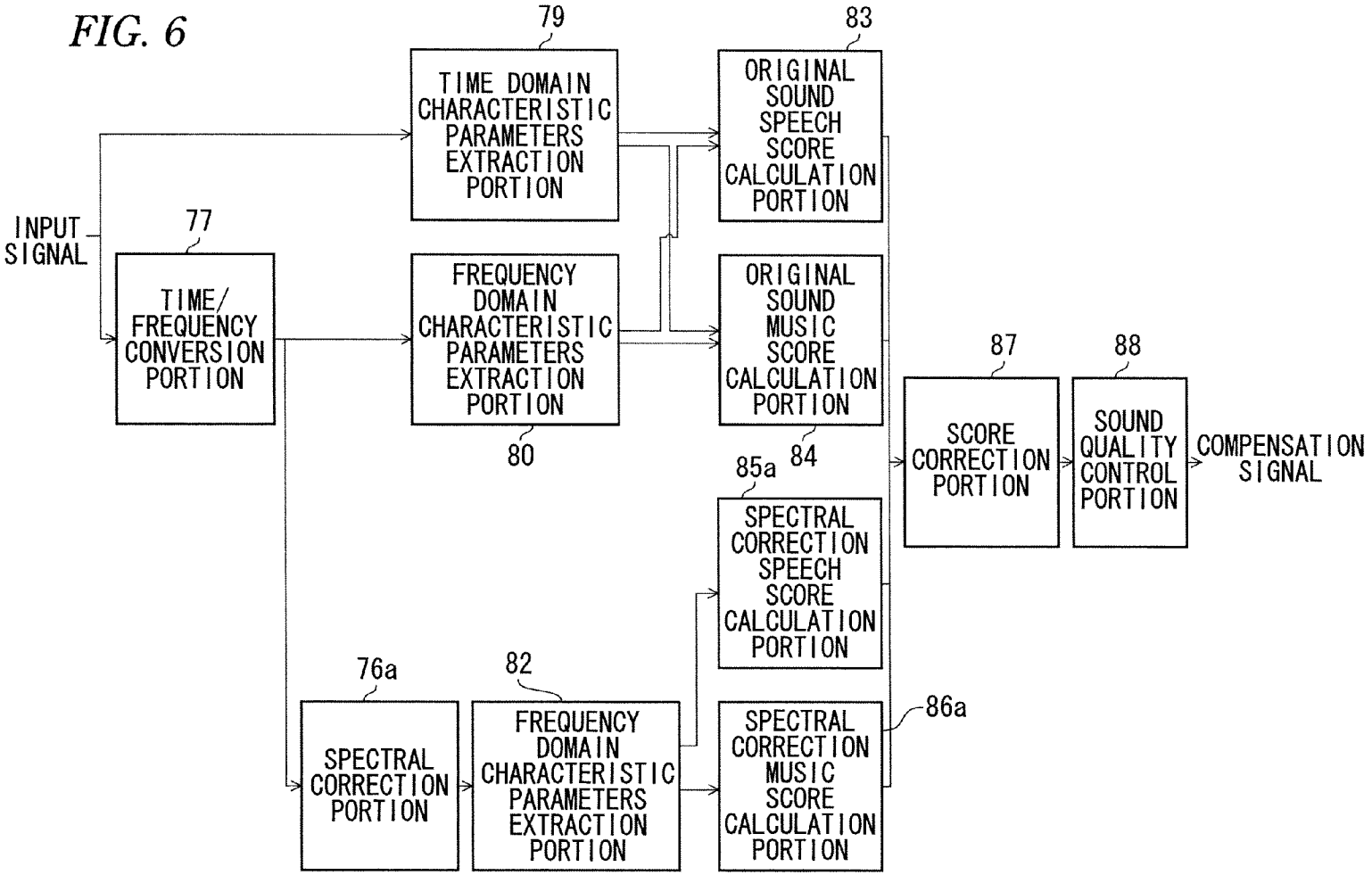
FIG. 6 illustrates an example block configuration of a sound quality control device according to Embodiment 2.

FIG. 6 illustrates an example block configuration of a sound quality control device according to Embodiment 2, which adaptively performs sound quality control processing. A sound quality control device according to Embodiment 2 is provided with a spectral correction portion 76*a* that processes a spectral signal obtained by the time/frequency conversion of an input signal, instead of the compensation filter 76, as compared with Embodiment 1. This configuration is provided to decrease the number of times of performing the time-frequency domain conversion to 1, thereby reducing throughput. The spectral correction portion 76*a* is configured to perform, in a frequency domain, processing to be performed by the compensation filter 76. Center enhancement is processing to enhance a sum of the LR channel components in every spectral bin (or frequency band width) corresponding to each channel. Speech band enhancement is performed on a spectral signal to enhance a frequency band of 300 Hz to 7 kHz, in which the component of a speech signal is likely to more prominently appear, with a fast Fourier transform (FET) filter (or to attenuate the signal component of the other frequency bands). Noise suppression is to suppress stationary noise components by a spectral subtraction method or the like. The spectral signal is corrected into a signal suitable for speech extraction through these types of spectral correction processing. The device of this configuration performs frequency domain characteristic parameters extraction, filtered speech score calculation and filtered music score calculation, similarly to that of the configuration illustrated in FIG. 2. Preliminarily learned coefficients through the spectral correction processing are utilized as the weighting coefficients for the calculation of the scores in the linear discrimination performed at the filtered (spectral correction) speech score calculation portion and the filtered (spectral correction) music score calculation portion in this configuration. Subsequent processing blocks, i.e., the score correction portion 87 and the sound quality control portion 88 are configured to operate, similarly to those in the configuration illustrated in FIG. 2.

The sound quality can be enhanced by performing the speech/music discrimination on audio signals, and controlling the various types of correction processing respectively suitable for the mixed signals, as described in the foregoing description of the embodiments. The points of the embodiments are described below.

(1) When the characteristic of an audio input signal is analyzed, and the similarity level to speech and that to music are determined by scoring, the characteristic parameters extraction and the score determination are performed on the speech/music mixture signals, i.e., the signals passed through the compensation filter suitable for speech extraction, in addition to the original sound signals. Then, the correction of the scores is performed on the original sound signal and the filtered signal, based on the score difference. Consequently, the accuracy of detecting speech embedded in the mixed signal is enhanced. In addition, sound quality control suitable therefor is performed.

(2) The compensation filter suitable for speech extraction is configured to facilitate the detection of a speech signal by performing, on speech signals mixed with the other type of signals, one or more of the center enhancement, the speech band enhancement and the noise suppression.

(3) The spectral correction portion performs, on the signal subjected to the time/frequency conversion, spectral correction processing that is equivalent to the compensation filtering processing and that includes one or more of the speech band enhancement and the center enhancement, instead of the compensation filter. Thus, as compared with the configuration using the compensation filter, the processing load of the time/frequency conversion is reduced. Thus, the accuracy of detecting speech embedded in the mixed signal is enhanced. In addition, sound quality control suitable therefor is performed.

Accordingly, when determining whether the original sound input signal superimposed with a mixed signal and with signals representing background sounds (handclaps, cheers, BGM and the like) represents speech or music, the scoring of the similarity level to speech and that to music from each characteristic parameter value is performed. In addition, the scoring-correction is performed on the signals subjected to the compensation filtering processing (the speech band enhancement, the center enhancement and the like) suitable for speech extraction, utilizing parameters obtained by scoring, according to the difference therebetween. Thus, detection accuracy for a mixed signal containing a speech signal can be enhanced. In addition, effective sound quality control suitable for an input signal can be realized.

The spectral correction processing is performed on the signal subjected to the time/frequency conversion as an alternative of the compensation filtering processing. Thus, increase in the processing load due to the addition of the compensation filter can be alleviated.

The present invention is not limited to the above embodiments, and can be embodied by changing the components thereof without departing the scope of the invention.

In addition, various inventions can be made by appropriately combining plural components in the embodiments. For example, several components may be deleted from all the components in the embodiment. And, components of different embodiments can appropriately be combined with one another.

What is claimed is:

1. A sound quality correction device, comprising:

a time-domain characteristic parameters extraction module configured to analyze an audio input signal in a time domain to thereby extract time-domain characteristic parameters;

a time/frequency conversion module configured to convert the audio input signal into a frequency-domain signal;

a frequency-domain characteristic parameters extraction module configured to analyze an output from the time/frequency conversion module to thereby extract frequency-domain characteristic parameters;

a first speech score calculation module configured to calculate a first speech score based on outputs from the time-domain characteristic parameters extraction module and the frequency-domain characteristic parameters extraction module, the first speech score representing a similarity to speech signal characteristics;

a first music score calculation module configured to calculate a first music score based on the outputs from the time-domain characteristic parameters extraction module and the frequency-domain characteristic parameters extraction module, the first music score representing a similarity to music signal characteristics;

a compensation filtering processing module configured to perform at least one of processings of a center enhancement, a speech band enhancement and a noise suppression onto the audio input signal;

a second speech score calculation module configured to calculate a second speech score based on an output from the compensation filtering processing module, the second speech score representing a similarity to the speech signal characteristics;

a second music score calculation module configured to calculate a second music score based on the output from the compensation filtering processing module, the second music score representing a similarity to the music signal characteristics;

a score correction module configured to correct the first speech score based on a difference between the first speech score and the second speech score, and to correct the first music score based on a difference between the first music score and the second music score; and a sound quality correction module configured to perform a sound quality control on the audio input signal based on the speech score and the music score obtained from the score correction module.

2. The device of claim 1, wherein the compensation filtering processing module comprises a filtering processing which operates in the time domain and which enhances a speech signal.

3. The device of claim 1, wherein the compensation filtering processing module comprises a spectral correction processing which uses the output from the time/frequency conversion module, which operates in a frequency domain and which enhances a speech signal.

4. The device of claim 1, further comprising:

an output module configured to output an audio output signal for which the sound quality control has been performed by the sound quality control module.

5. A sound quality correction method, comprising:

analyzing an audio input signal in a time domain to thereby extract time-domain characteristic parameters;

converting the audio input signal into a frequency-domain signal;

extracting frequency-domain characteristic parameters;

calculating a first speech score based on the time-domain characteristic parameters and the frequency-domain characteristic parameters, the first speech score representing a similarity to speech signal characteristics;

calculating a first music score based on the time-domain characteristic parameters and the frequency-domain characteristic parameters, the first music score representing a similarity to music signal characteristics;

performing at least one of compensation filtering proces sings of a center enhancement, a speech band enhancement and a noise suppression onto the audio input signal;

calculating a second speech score based on a result of the compensation filtering processing, the second speech score representing a similarity to the speech signal characteristics;

calculating a second music score based on the result of the compensation filtering processing, the second music score representing a similarity to the music signal characteristics;

correcting the first speech score based on a difference between the first speech score and the second speech score, and correcting the first music score based on a difference between the first music score and the second music score; and performing a sound quality control on the audio input signal based on the speech score and the music score obtained from the correction result.

* * * * *